United States Patent [19]

Balne

[11] 4,120,472

[45] Oct. 17, 1978

[54] LADDER CADDY WITH RUNG CATCH MEANS

[76] Inventor: John Alfred Balne, 1247 Haig Blvd., Mississauga, Ontario, Canada

[21] Appl. No.: 829,789

[22] Filed: Sep. 1, 1977

[51] Int. Cl.[2] ..... E06C 7/14

[52] U.S. Cl. ..... 248/211; 248/215; 248/225.2

[58] Field of Search ..... 248/211, 210, 215, 238, 248/217.1, 224.3, 225.1, 225.2

[56] References Cited

U.S. PATENT DOCUMENTS

| | | | |
|---|---|---|---|
| 1,394,301 | 10/1921 | Hayes | 248/217.1 |
| 1,601,652 | 9/1926 | Sohnle | 248/211 |
| 2,735,641 | 2/1956 | Voecks | 248/210 |
| 2,991,037 | 7/1961 | Becher | 248/211 |

FOREIGN PATENT DOCUMENTS

| | | | |
|---|---|---|---|
| 683,720 | 12/1952 | United Kingdom | 248/210 |

*Primary Examiner*—Robert A. Hafer

[57] ABSTRACT

A ladder caddy for attachment to a side rail of a ladder to provide an attachment support for tools, paint can etc., the caddy having a J-shaped frame to straddle a side rail with a dual bight in one embodiment to provide built in capability to fit two ranges of width of ladder side rails and rung catch means for engagement with a surface of one of the ladder rungs. In one embodiment the rung catch means is a rung insert of star-shaped section having trimmable lobes, to permit selective fitting of the support plug to the interior surface of the ladder rung in the use of ladders where the interior of the rungs are accessible; a further embodiment has rung catch means comprising an internal hook member for insertion within a ladder rung, and in another embodiment the rung catch means comprises a hook to engage externally over the ladder rung, being useable with most types of ladder.

10 Claims, 8 Drawing Figures

FIG. 3.
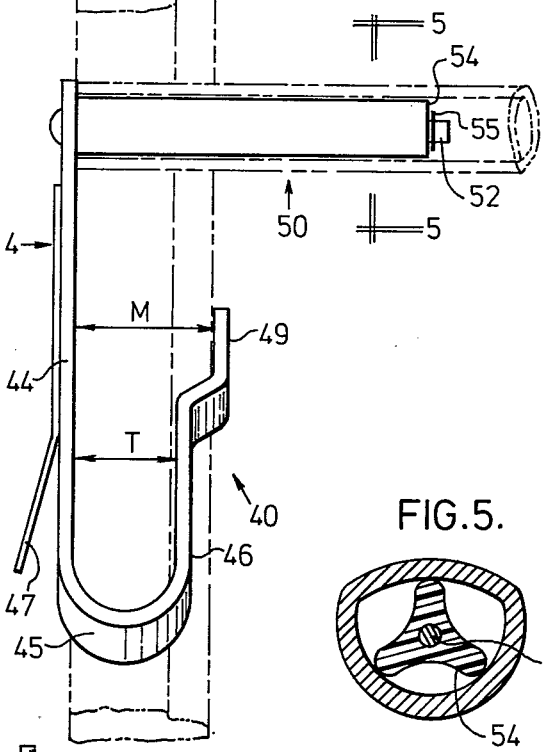
FIG. 2.
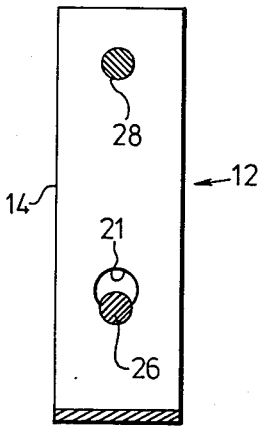
FIG. 5.
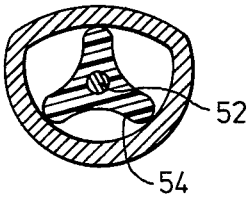
FIG. 6.
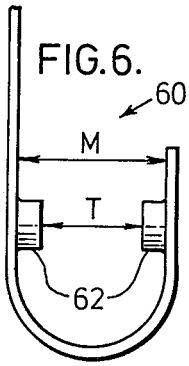
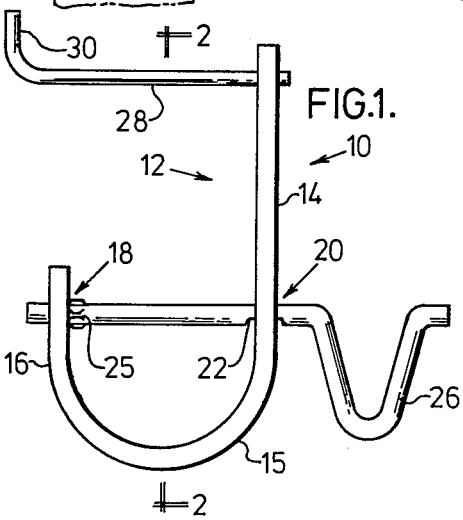
FIG. 1.
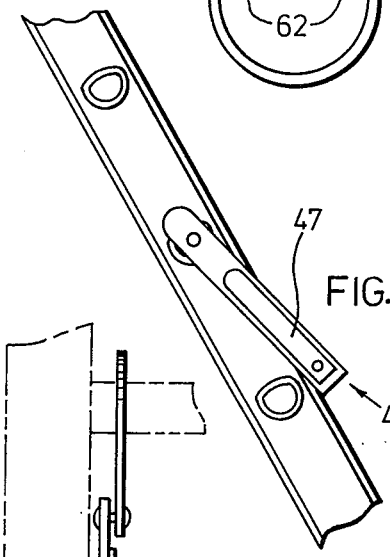
FIG. 4.
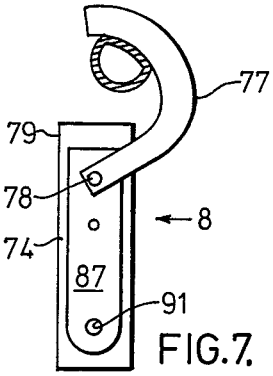
FIG. 7.
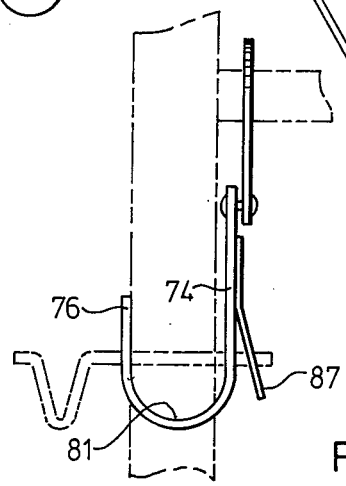
FIG. 8.

LADDER CADDY WITH RUNG CATCH MEANS

This invention is directed to an improved ladder caddy, and in particular to a ladder caddy for use with ladders, having rung catch means to engage a ladder rung and a J-shaped frame to straddle a side rail of the ladder.

A current example of a ladder caddy for supporting tools, paint cans etc., can be seen in my U.S. Pat. No. 3,979,997 which incorporates an adjustable frame to straddle either of the ladder side rails, having a recess in the frame side members forming a hook portion to engage a ladder rung, thereby permitting securing of the caddy in engaged relation with a rung on either of the side rails of the ladder.

One embodiment of the presently disclosed arrangement provides a simplified caddy adopted for use with aluminum ladders of the type having tubular rungs extending through the walls of the ladder side rail extrusions, wherein the interior of the rung sections are accessible through the side rails, to receive rung catch means of the caddy in entered relation therein, to transfer useful load from the caddy to the ladder.

A further embodiment of the caddy incorporates rung catch means of the external hook type pivotally attached to a longer limb portion of the frame of the caddy, to engage a rung of the ladder in load transfer relation therewith.

The improved caddy is provided with a frame of J form referred to herein as a J-frame, the first embodiment having a transversely extending cantilevered insert spindle means forming the rung catch means extending from the longer limb of the J-frame, to fit within the hollow rungs. The two limbs of the J-frame engage one or other of the rails of the ladder, to position the caddy in engaged hooked and straddled relation with a rung and a side rail, to support loads from the caddy.

In the preferred embodiment the bight between the long and the short limbs of the J-frame has a wider mouth portion and an adjacent narrower throat portion. The wider mouth portion provides gripping capability of the J-frame with a ladder having a correspondingly wide rail, while the narrower throat portion can receive a narrower gauge rail. This arrangement provides stable rail gripping capability of the J-frame necessary to ensure stable mounting of an appliance suspension spindle, in relation to more than one width of ladder rail.

In addition to the two -size range for different rail widths, one embodiment also features rung catch means comprising rung insert spindle means including an extruded plastic rung plug having a plurality of star points or lobes that may be readily selectively trimmed to effect reduction in the size of the plug, so as to permit entry of the plug into a rung of smaller internal dimension. The rung plug is rotatably supported on a central cantilevered spindle.

The J-frame of each embodiment is provided with a pair of aligned holes in the limbs of the J-frame, to receive an accessory support spindle in removeable, laterally extending relation from the caddy, by which tools and other devices may be suspended on the caddy. The spindle is usually retained by way of a cantilevered spring, which grips the side of the accessory support spindle. An alternative spindle retention arrangement also is provided.

Certain embodiments of the invention are described, reference being made to the accompanying drawings, wherein;

FIG. 1 is a plan view of a first embodiment of the invention having a cranked rung insert spindle;

FIG. 2 is a view at 2—2 of FIG. 1

FIG. 3 is a general view of a second, preferred embodiment of the invention in mounted relation with portions of a ladder shown in phantom;

FIG. 4 is a side view in the direction of arrow 4 of FIG. 3, to a reduced scale, showing the ladder in full lines;

FIG. 5 is a view at 5—5 of FIG. 3;

FIG. 6 is a plan view of a portion of J-frame of a third embodiment;

FIG. 7 is a side view of an embodiment of the invention having a pivotal hook as the rung catch means, with a rung shown in section, and FIG. 8 is a view in the direction 8 of FIG. 7 and including in phantom a portion of ladder rail.

Referring first to FIGS. 1 and 2, the illustrated first embodiment 10 comprises a J-frame portion 12 having a long limb 14 and a short limb 16 with a curved bight portion 15 extending therebetween. The limbs 14, 16 are apertured at 18, 20 with a pair of aligned bores to receive an appliance hook spindle 26. The outer bore 21 is of larger diameter than the other bore at 18, in limb 16, to permit the retention of an appliance spindle 26 by the provision of shoulder 22 thereon which bears against the bottom edge of bore 18, to lock the illustrated appliance hook spindle 26 against withdrawal. A punch-out detent 25 limits the inward insertion of the appliance spindle 26 into the bore 18, the bore at 20 being of sufficient dimension to permit passage of the detent 25 therethrough.

Rung catch means comprise a spindle 28 secured to the upper end of the limb 14 having an upturned end portion 30 to permit insertion of the rung spindle 28 within a ladder rung, the end portion 30 bearing upwardly against the interior of the rung to limit twisting of the J frame, upon the application of load to the appliance hook spindle 26.

Referring now to the preferred embodiment illustrated in FIGS. 3, 4 and 5, the caddy 40 has a generally J-shaped frame 42 with a long limb 44 and short limb 46, with a curved bight portion 45 therebetween.

The limbs 44, 46 are apertured with bores aligned as those of the first embodiment, to permit mounting of an appliance spindle therethrough.

A cantilever spring is illustrated having a hole therethrough to receive an appliance spindle when spring 47 is depressed, thereby providing a lock against withdrawal of the appliance spindle when the spring 47 assumes its normal underformed position.

The short limb 46 of caddy 40 has a cranked end portion 49 which forms a wider mouth portion of width M to receive a ladder side rail of corresponding width, as indicated in phantom.

The adjoining portion of limb 46 forms a throat portion of width T to receive a ladder side rail of corresponding width, also indicated in phantom.

Rung catch means comprise a rung spindle means 50 having a central spindle 52 secured in rigid cantilevered relation from the long limb 44, with a plug portion 54 of generally multi-lobed section, referred to as a star-section. The radially outer lobe portions of plug 54 are of selected material and fine-ness to permit ready trimming by hand, whereby the rung plug 54 may be readily pared to fit snugly within the rung interiors of a particular ladder such as that of a householder, purchaser of the device. It is contemplated that score lines may well be provided along the lobes of plug 54 to facilitate and even guide the paring operation.

Referring to FIG. 5 a third embodiment having a plain J-frame 60 similar to that of FIG. 1 is provided with a pair of pad portions 62 to provide a mouth portion of width M and a throat portion of width T, to extend the range of ladder rail widths with which the third embodiment may be used. The pads 62 may be aligned with through apertures (not shown) in which are received a spindle for a appliance hook, such as hook 26 of FIG. 1.

While not illustrated, it will be evident that the rung spindle means may be selected for optimum utility from the illustrated embodiments, while a cantilever spring corresponding to spring 47 of FIG. 3 or an arrangement such as the FIG. 1 hook spindle 26 may be readily adopted.

It is contemplated that in place of a lobed plug 54, a plain cylindrical plug may be substituted.

The provision of a circlip 55 permits ready substitution of one type of rung plug for another.

Referring to FIGS. 7 and 8, the caddy 70 has J-frame limbs 74 and 76, the longer limb 74 having rung catch means comprising a hook 77 secured by pivot 78 to the limb 74 adjacent the end 79 of the J-frame remote from the curved bight portion 81 thereof.

A cantilever spring 87 provides for retention of a load bearing spindle entered through a bore 91, the spindle being indicated in phantom.

The relationship of the length of limb 74 of the J-frame and the location of the pivot 78 may be such as to bring the upper end portion 79 into locking contact with the underside of the rung, illustrated in section in FIG. 7, when the hook 77 is fully engaged with the rung.

In all embodiments the respective rung catch means confer additional stability to the respective caddy, in relation to the asymetrical torquing load normally exerted by the load bearing spindles against the caddy.

What I claim is:

1. In a ladder caddy, for use with house ladders of the type having opposed side rails and a plurality of rungs extending therebetween, said caddy having a frame portion comprising a rigid J-frame having a long limb and a short limb, said limbs forming a bight therebetween to straddle over a said ladder side rail when in use with an erected ladder to locate said side rail in partially entered relation between said limbs, each said limb having a bore therethrough, the bores being in mutually aligned relation to receive an appliance support spindle in substantially horizontally extending relation therethrough in load transfer relation with said rigid J-frame, and rung catch means attached to said long limb and extending therefrom to engage a said rung, to pivotally secure said J-frame in stable mounted and load supporting relation upon said ladder.

2. The ladder caddy as claimed in claim 1 wherein said rung catch means comprises spindle means extending laterally from adjacent the end of said long limb opposite to said bight, in use as follows to extend within the interior of a said rung in load transfer relation therewith.

3. The ladder caddy as claimed in claim 2 said J-frame having a first mouth portion of predetermined width, in use as follows to receive a first size of ladder side rail in engaged relation therein, and a second throat portion adjacent said mouth portion, in use as follows to receive a ladder side rail of a second size less than said first size.

4. The ladder caddy as claimed in claim 2 said spindle means having an outer plug portion, in use as follows to slideably penetrate a said rung interior in withdrawable fitting relation therewith.

5. The ladder caddy as claimed in claim 2 said spindle means outer plug portion comprising a star-section having a plurality of extending arm portions, in use as follows to provide engagement with an interior surface portion of said rung interior.

6. The ladder caddy as claimed in claim 5 said spindle star-section arm portions having radialy outer extremities of reduced thickness being of a readily trimmable material, to facilitate hand trimming of the star section in use as follows to fit effectively in caddy securing relation within the interior of rungs of a selected said ladder.

7. The ladder caddy as claimed in claim 4 said spindle means outer portion comprising a substantially cylindrical section rotatably mounted on a spindle shaft, and attachment means securing said cylindrical section to the shaft.

8. The ladder caddy as claimed in claim 3 said first mouth portion and said second throat portion comprising a long limb and short limb of said J-section having a curved bight portion in conjoining relation therebetween, said short limb having an outer end portion extending in cranked relation away from the long limb to provide said first mouth portion.

9. The ladder caddy as claimed in claim 3 said J-frame short limb extending in substantially parallel relation with said long limb for substantially the full length of the short limb, and shoulder means secured to at least one said limb in facing relation with the other limb, and spaced from said bight a distance sufficient to provide in cooperation with said short limb said first mouth portion located outwardly of said shoulder means, said second throat portion extending inwardly therefrom towards said bight.

10. The ladder caddy as claimed in claim 1, wherein said rung catch means comprises hook means pivotally attached to said long limb adjacent the end thereof remote from said bight, for positioning, in use as follows in hooked load transfer relation with said rung.

* * * * *